US008918942B1

(12) United States Patent
Timmermeyer

(10) Patent No.: US 8,918,942 B1
(45) Date of Patent: Dec. 30, 2014

(54) RECIPROCATING GROUT CLEANING APPARATUS

(76) Inventor: Robert Timmermeyer, Hughson, CA (US)

( * ) Notice: Subject to any disclaimer, the term of this patent is extended or adjusted under 35 U.S.C. 154(b) by 246 days.

(21) Appl. No.: 13/597,194

(22) Filed: Aug. 28, 2012

(51) Int. Cl.
*A47L 11/24* (2006.01)
*A46B 13/02* (2006.01)
*A47L 11/12* (2006.01)

(52) U.S. Cl.
CPC ..... *A47L 11/12* (2013.01)
USPC ..... 15/52.2; 15/50.2; 15/21.1

(58) Field of Classification Search
USPC ..... 15/22.1, 22.2, 33, 37, 50.2, 52.2
See application file for complete search history.

(56) References Cited

U.S. PATENT DOCUMENTS 3,453,732 A * 7/1969 Wilkin ..... 30/296.1
5,381,578 A * 1/1995 Armbruster ..... 15/98
6,120,363 A * 9/2000 Dunn ..... 451/356
7,937,792 B2 * 5/2011 Munn et al. ..... 15/28
2004/0265043 A1 * 12/2004 Palme ..... 401/289

* cited by examiner

*Primary Examiner* — Shay Karls
(74) *Attorney, Agent, or Firm* — Mahamedi Paradice LLP

(57) ABSTRACT

An apparatus for grout cleaning is discussed below that enables a user to easily and effectively perform tile and grout cleaning tasks without having to engage in an uncomfortable posture and without requiring a large amount energy or muscle strength spent on the reciprocating, repetitive movement associated with such tasks. In some embodiments, a grout cleaning device comprises an elongated arm having a proximal end and a distal end; a reciprocating motor attached to the distal end and having a power source; a grout cleaning member detachably coupled to the reciprocating motor; and a motor controller attached to the proximal end, wherein the motor controller is operable to selectively control the power source. The motor controller may change an operating speed of the reciprocating motor according to an input from the user. The elongated arm may include one or more contour portions to provide an ergonomic position for the user.

20 Claims, 5 Drawing Sheets

RECIPROCATING GROUT CLEANING APPARATUS

TECHNICAL FIELD

This invention relates generally to cleaning devices, and specifically to powered tile and grout cleaning tools.

BACKGROUND

In modern homes, grout is often used as a construction material to attach tiles and to fill the spaces between the tiles in order to form a watertight surface for places like shower stalls, floors, or kitchen countertops. With use over time, it is common for dirt, soap scum, water stains, or even fungus to build up on the tiles and especially on the grout in between the tile flooring surfaces (or the grout lines).

There are a variety of cleaning brushes commercially available for grout cleaning. However, cleaning the grout lines using currently available brushes typically involves labor intensive scrubbing and brushing in a posture that is uncomfortable to a user including, for example, crouch, prone, leaning, or bending over. These awkward positions, in combination with the muscle strength required to reciprocally and repetitively move the brushes, severely limit a person's ability to clean the grout lines because of his or her limited stamina. Also, these negative traits of conventional grout cleaning activities increase the probability of causing or inducing injuries associated with engaging in such activities.

BRIEF DESCRIPTION OF THE DRAWINGS

In the features and advantages of the present invention are illustrated by way of example and are by no means intended to limit the scope of the present invention to the particular embodiments shown, and in which.

Like reference numerals refer to corresponding parts throughout the drawing figures.

DETAILED DESCRIPTION

An apparatus for grout cleaning is discussed below that enables a user to easily and effectively perform tile and grout cleaning tasks without having to engage in an uncomfortable posture and without requiring a large amount energy or muscle strength spent on the reciprocating, repetitive movement associated with such tasks. In some embodiments, a grout cleaning device comprises an elongated arm having a proximal end and a distal end; a reciprocating motor attached to the distal end and having a power source; a grout cleaning member detachably coupled to the reciprocating motor; and a motor controller attached to the proximal end, wherein the motor controller is operable to selectively control the power source. The motor controller may change an operating speed of the reciprocating motor in response to an input from the user. The elongated arm may include one or more contour portions to provide an ergonomic position for the user.

In the following description, numerous specific details are set forth such as examples of specific components to provide a thorough understanding of the present disclosure. Also, in the following description and for purposes of explanation, specific nomenclature is set forth to provide a thorough understanding of the present embodiments. However, it will be apparent to one skilled in the art that these specific details may not be required to practice the present embodiments. The present embodiments are not to be construed as limited to specific examples described herein but rather to include within their scope all embodiments defined by the appended claims.

Figure 1:
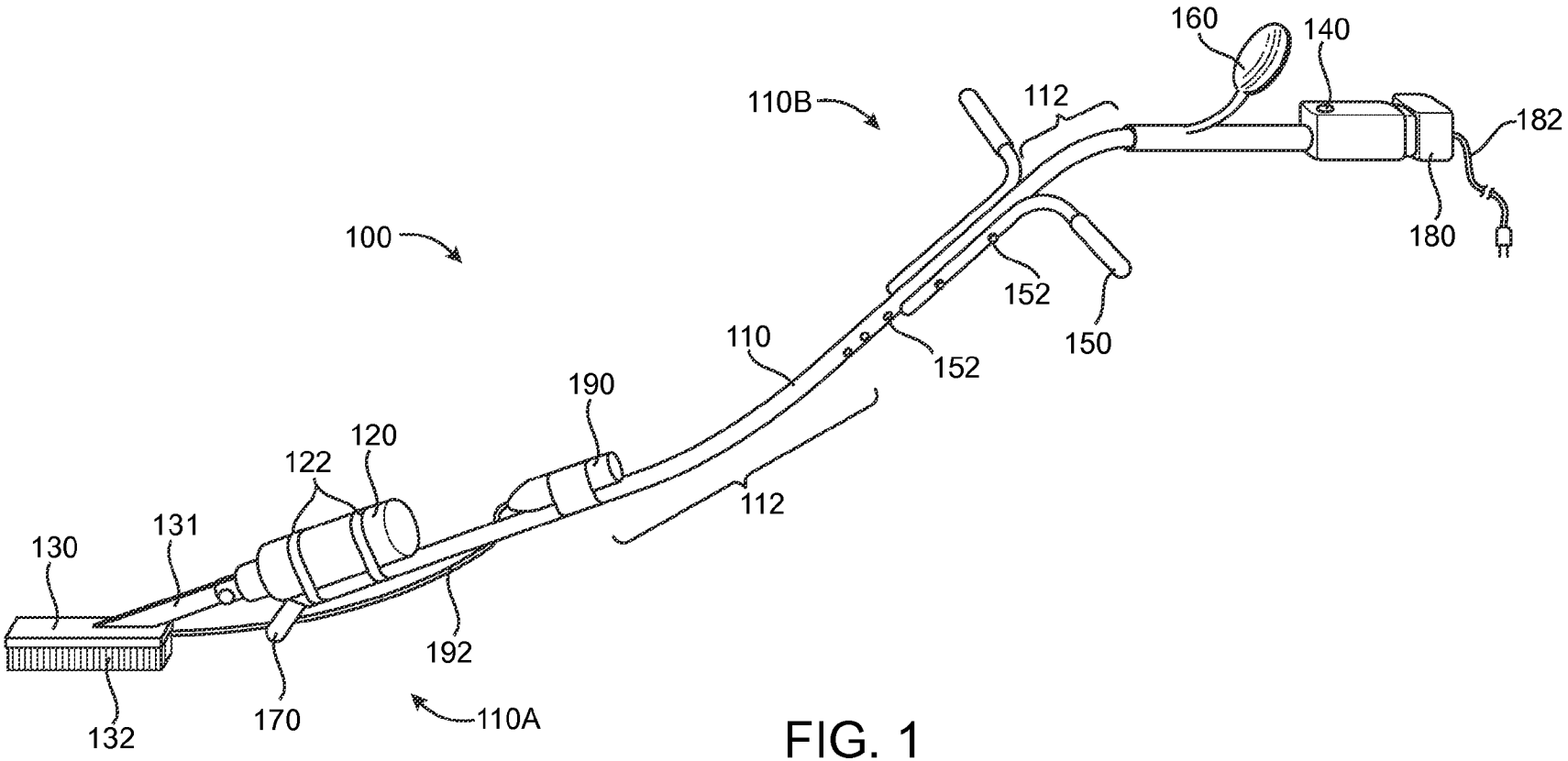
FIG. 1 is an elevated perspective view of a grout cleaning device in accordance with the present embodiments.

FIG. 1 is an elevated perspective view of a grout cleaning device 100 in accordance with the present embodiments. Cleaning device 100 includes an elongated arm 110, a reciprocating motor 120, a tile/grout cleaning member 130, and a motor controller 140. The elongated arm 110 functions as a main supporting member that is substantially tubular in shape. The arm 110 can be made from any rigid, strong and durable materials including, for example, stainless steel, aluminum alloys, or other suitable materials, and can be of any dimensions suitable for use with grout or tile cleaning. In many embodiments, the arm 110 has a length that enables a user to hold the device 100 in an ergonomic posture, for example, a natural standing position. The cross-sectional shape of the arm 110 can be any suitable shape that allows it to be strong and durable. For some embodiments, the cross-sectional shape of the arm 110 is circular, as illustrated in the figures. For other embodiments, the cross-sectional shape of the arm 110 can be rectangular, elliptical, triangular, octagonal, or some other suitable shape.

The elongated arm 110 is characterized by a longitudinal axis that is collinear with a length of arm 110 extending between proximal and distal ends 110A and 1108, respectively, of the arm 110. In one or more embodiments, a handle 150 is provided on an upper portion of the elongated arm 110 (e.g., near the proximal end 110A) to provide a pivot for the user. The handle 150 can be made of suitable material and can have a rubber portion to provide extra grip. In some of the embodiments that include the handle 150, the handle 150 is permanently affixed to the arm 110. In other embodiments, however, the handle 150 is detachable from the arm 110. The handle 150 can be secured to the attachment points 152 using typical screws and bolts, although other suitable mechanisms for securing the handle 150 may be used. In the embodiments with detachable handles, the arm 110 may include a plurality of attachment points 152 for securing the handle 150 so that a position of the handle 150 with respect to the arm 110 is adjustable. For example, the user can adjust the handle 150's position by using different combinations of the attachment points 152 so that the handle 150 moves upward or downward along the longitudinal axis of the arm 110. In this way, the user can adjust the handle 150 to a position that provides a more natural and comfortable upper torso and arm posture and according to the user's own stature. Notably, the position provided by the plurality of attachment points 152 on the arm 110 can be ambidextrous, for example, so that a left-handed user can easily adjust the handle 150's position for his or her comfort just as easily as a right-handed user can.

As an addition or alternative to embodiments described above, the elongated arm 110 may include a telescopic portion (not shown in FIG. 1 for simplicity) in order to adjust a length of the arm 110 so that the user can be engaged in a natural and comfortable posture (e.g., without having to bend over at the waist) when using the device 100. In other examples, the elongated arm 110 may include one or more contour portions 112 to provide an ergonomic position for the user. In yet another embodiment, an elbow support 160 may be provided or coupled to the proximal end 110A of the elongated arm 110. Overall, the present embodiments include a variety of features that enable a user to easily and effectively perform tile and grout cleaning tasks without having to engage in an uncomfortable posture.

The reciprocating motor 120 is attached to the distal end 110B of the arm 110 and has a power source 180. The reciprocating motor 120 converts energy provided by the power source 180 into reciprocating (e.g., back and forth) motions along a reciprocation axis. Depending on the embodiment, the power source 180 can be electricity or other suitable power including, for example, fossil fuels or other chemicals. In some embodiments, the electricity for the reciprocating motor 120 is provided by a battery, and the motor 120 is coupled to the battery through connections (not shown in FIG. 1 for simplicity) within the arm 110 to receive the electricity. In other embodiments, the electricity for the reciprocating motor 120 is provided by a typical electric outlet, and the motor 120 is coupled to a power cord 182 attachable to the electric outlet to receive the electricity. In the case that the power source 180 is fossil fuel, the reciprocating motor 120 may comprise a piston engine that converts the chemical energy stored in the fuel into reciprocating motions. Other embodiments of the reciprocating motor 120 may include a pneumatic system that converts gas pressure into reciprocating motions.

The motor 120 can be attached to the arm 110 via one or more motor mounts 122, which can securely fasten the reciprocating motor 120 to the arm 110. In one example, the reciprocation axis can be substantially parallel or in line with the longitudinal axis that characterizes the arm 110. In other examples, the reciprocation axis may form an acute angle (e.g., from 15 to 75 degrees with respect to the longitudinal axis) so as to encourage the user's ergonomic posture. In some embodiments, instead of the one or more motor mounts 122, the motor 120 is attached to the distal end 110B of the arm 110 via a directional connector.

Figure 2A:
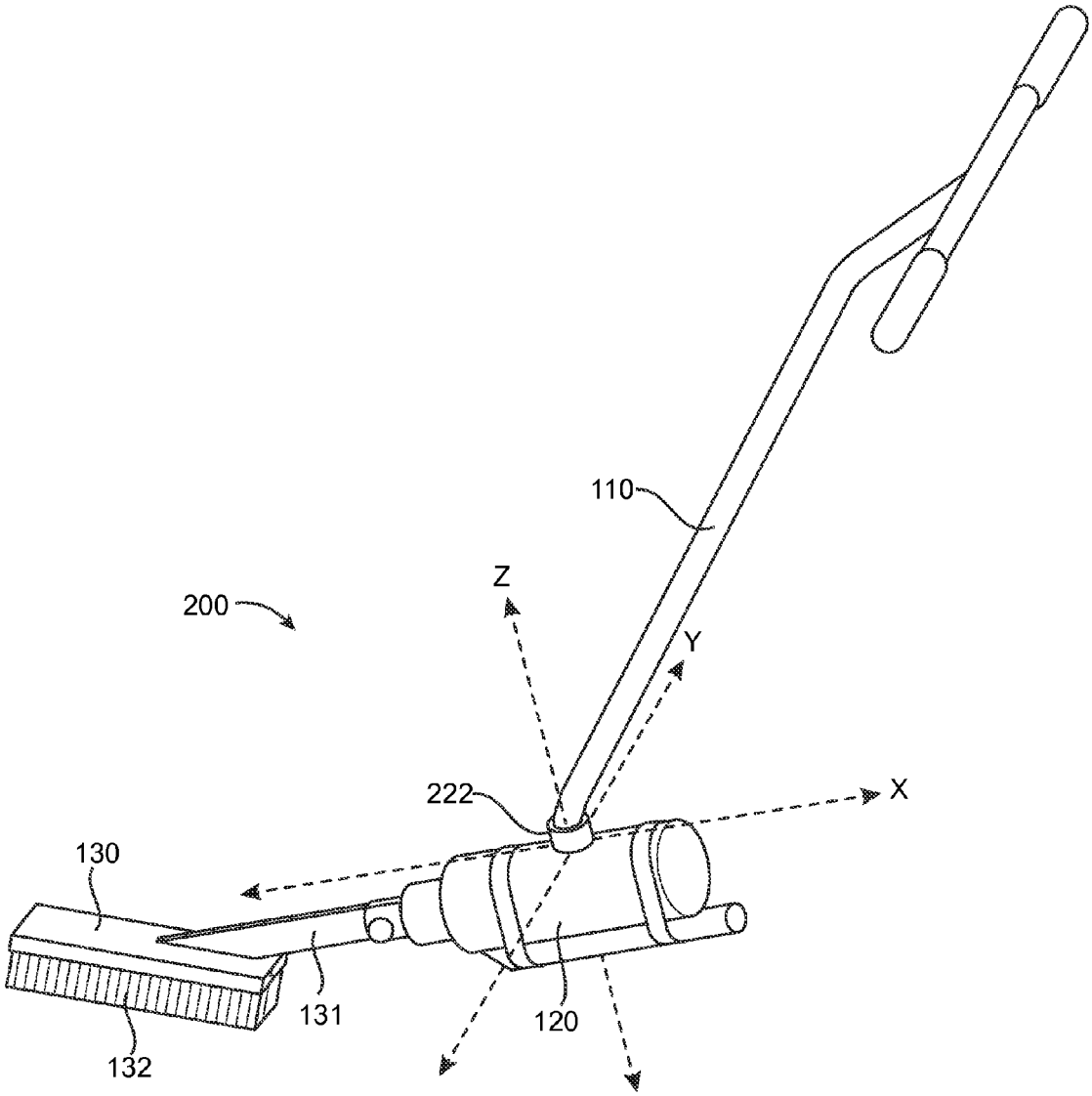
FIG. 2A is a side perspective view of another embodiment of the grout cleaning device of FIG. 1.

FIG. 2A shows a side view of another exemplary embodiment 200 of the grout cleaning device of FIG. 1. As illustrated in FIG. 2A, the grout cleaning device 200 includes a directional connector 222 that is rotatably connected to the distal end 110B of the arm 110 such that the directional connector 222 is adjustable to cause the reciprocation axis to change. More specifically, referring also to FIG. 2C, the reciprocating motor 120 may include a plurality of positioning holes 224 that provide a number of different positions for mounting the directional connector 222 to the reciprocating motor 120. In the example of FIG. 2A, the motor 120 is mounted or adjusted to a first position in which the reciprocation axis of the motor 120 is substantially parallel to the longitudinal axis that characterizes the arm 110 of the device 200.

Figure 2B:
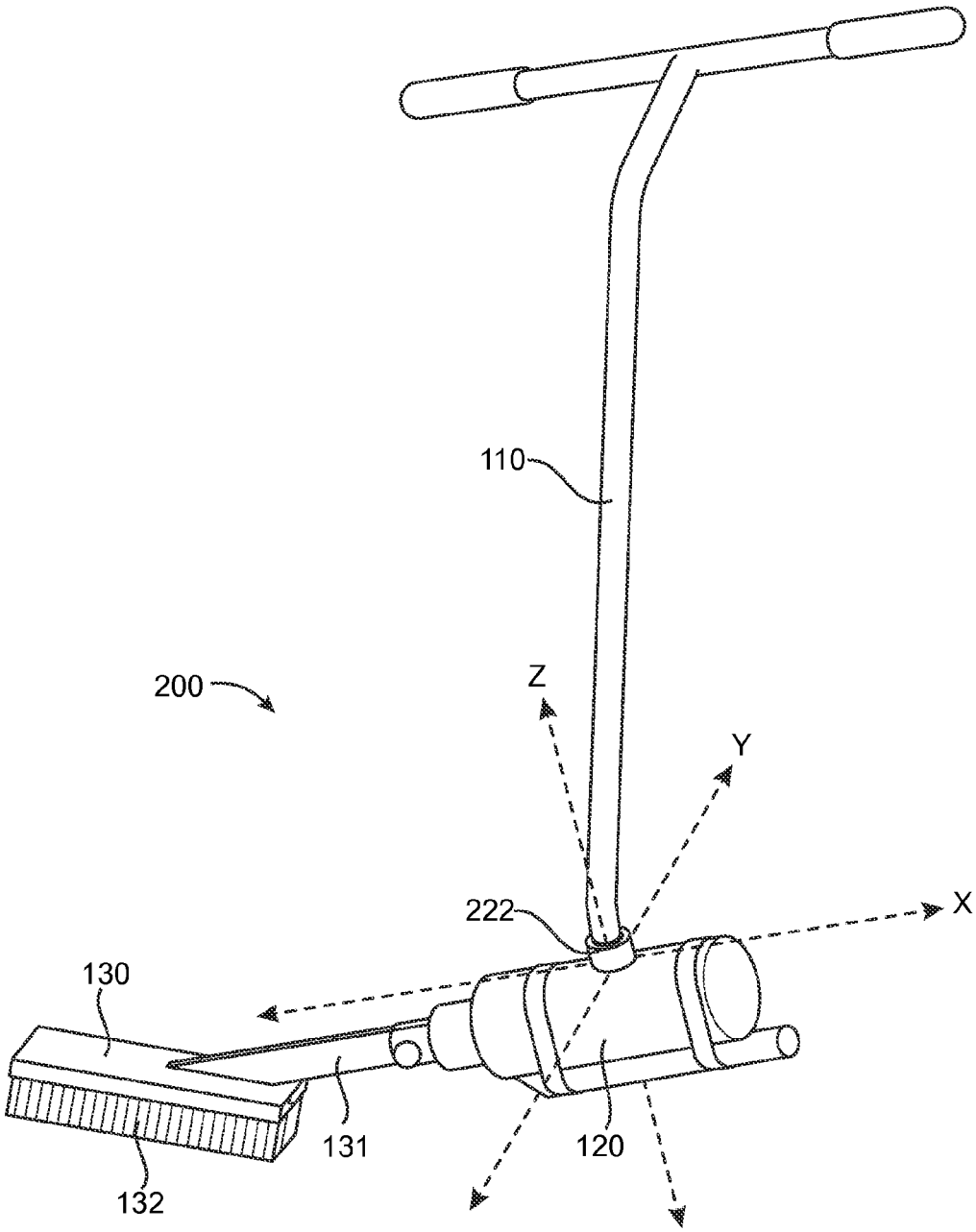
FIG. 2B is a side perspective view of the grout cleaning device of FIG. 2A with the reciprocation axis rotated 90 degrees.
Figure 2C:
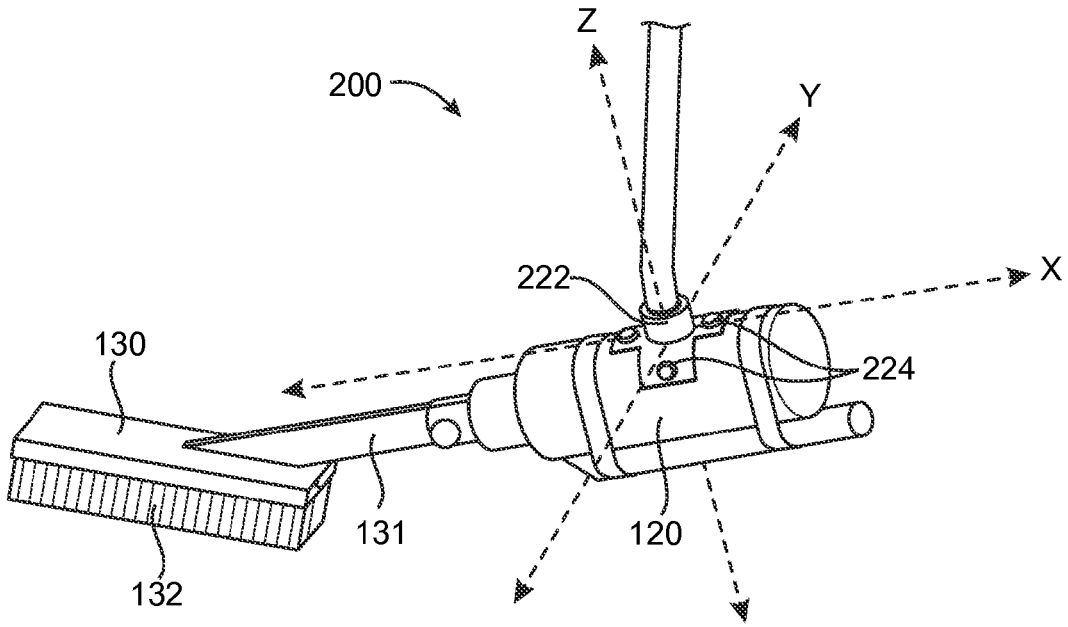
FIG. 2C is a more detailed view of the grout cleaning device of FIGS. 2A-2B.

FIG. 2B shows a side view of the grout cleaning device 200 of FIG. 2A with the reciprocation axis rotated 90 degrees. In the example of FIG. 2B, the motor 120 is mounted or adjusted to a second position in which the reciprocation axis of the motor 120 is substantially perpendicular to the longitudinal axis that characterizes the arm 110 of the device 200. In other words, the second position provided by the directional connector 222 causes the reciprocation axis of the motor 120 of FIG. 2B to rotate about 90 degrees with respect to the original, first position as illustrated in FIG. 2A.

Referring also to FIG. 1, the tile/grout cleaning member 130 may include a brush 132 and may be connected to or otherwise attached to an adaptor 131 that can be inserted into a receiving socket of the reciprocating motor 120, thereby allowing a reciprocating motion of the motor 120 to cause the brush 132 to move back-and-forth in a reciprocating motion collinear with the longitudinal axis of the arm 110. The brush 132 can be made of nylon, polypropylene, or other suitable materials including plastic or metallic ones. During normal operation, the reciprocating motor 120 drives the cleaning member 130 so that the brush 132 is applied against a working surface to remove dirt or other stains that are built up on the tiles and over the grouts. In this way, the motor 120 and the cleaning member 130 enable a user to easily and effectively perform tile and grout cleaning tasks without having to engage in an uncomfortable posture and without requiring a large amount energy or muscle strength spent on the reciprocating, repetitive movement associated with such tasks.

Notably, the reciprocating motion provided by the motor 120 is advantageous over rotary motions typically provided on powered grout cleaning tools because reciprocating brushes tend to be smaller in shape and can more easily reach tighter areas. Moreover, rotary brushes typically suffer from wearing out in only one direction, resulting in a shorter life span as compared to reciprocating brushes that are made of the same material and used under similar environments.

Figure 3:
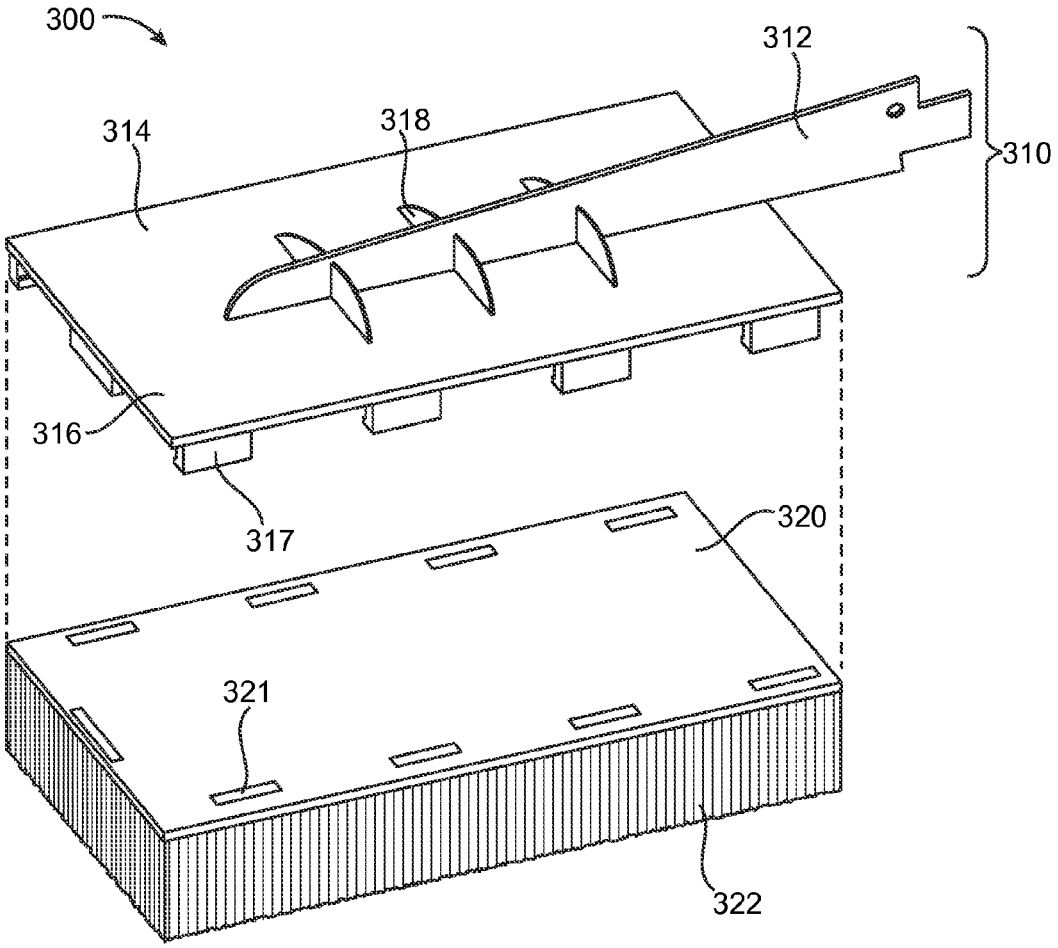
FIG. 3 is an exploded perspective view of an exemplary grout cleaning member that can be used with the grout cleaning devices disclosed herein.

FIG. 3 shows an exploded view of an exemplary grout cleaning member 300 which can be used with the grout cleaning devices disclosed herein. According to some embodiments, the cleaning member 300 comprises a motor adaptor assembly 310 and a brush member 320. The motor adaptor assembly 310 includes an adaptor arm 312, an attachment plate 314, and a brush socket 316. The adaptor arm 312 can be any suitable shape that enables the arm 312 to be affixed to a reciprocating motor (e.g., motor 120 of FIG. 1). The materials from which the adaptor arm 312 can be made include carbon steel, stainless steel, metal alloys, composites, or any other suitable material that is strong and durable. The attachment plate 314 is attached to the adaptor arm 312 and has a brush socket 316. The attachment plate 314 can be made of the same material as the adaptor arm 312, or can be made of other suitable strong and durable materials. The brush socket 316 has a dimension and shape that enables the brush member 320 to be securely fastened to the motor adaptor assembly 310 via the brush socket 316. In one embodiment, the brush socket 316 includes a plurality of teeth 317 so that the socket 316 can tightly receive the brush member 320 via holes 321 formed in the socket 316. The brush member 320 includes a bristle portion 322 similar to the brush 132 of FIG. 1. The brush member 320 is shaped in a suitable shape and dimension that allows it to be inserted into the brush socket 316 of the motor adaptor assembly 310.

As an additional embodiment, the motor adaptor assembly 310 may further include a plurality of reinforcement ribs 318 that connect the adaptor arm 312 and the attachment plate 314. The reinforcement ribs 318 can be made of the same material as the adaptor arm 312, or can be made of other suitable strong and durable material. The plurality of reinforcement ribs 318 can be placed such that the connection between the arm 312 and the plate 314 created by the ribs 318 increases a mechanical rigidity of the motor adaptor assembly 310. In other embodiments, the reinforcement ribs 318 can be used to enhance other kinds of overall mechanical characteristics of the motor adaptor assembly 310. In one implementation, the reinforcement ribs 318 are placed in a way that is substantially perpendicular to the adaptor arm 312, such as illustrated in FIG. 3.

Referring again to FIG. 1, the motor controller 140 is attached to the 110A end of the elongated arm 110 at a place that is easy to access by the user. The motor controller 140 is operable by the user to selectively control the power source of the reciprocating motor 120. In some embodiments, the motor controller 140 selectively controls the power source 180 by switching on and off the power source 180 according to an input from the user. According to some embodiments, the motor controller 140 may vary an intensity of the power source 180 so as to change or vary an operating speed of the reciprocating motor 120 according to the user's input.

Also, many examples of the present embodiments include a safety guard 170 extruding toward the working surface from the distal end 110B of the elongated arm 110. The safety guard 170 is positioned so as to prevent the distal end 110B of the arm 110 and/or the reciprocating motor 120 from contacting, colliding or damaging the working surface in case the grout cleaning member 130 becomes accidentally detached (e.g., if the adaptor 131 breaks due to metal fatigue) during normal operation. In some examples, the safe guard 170 comprises a guiding wheel (not shown for simplicity) for easier directional guidance and for further alleviating the amount of pressure the user needs to apply on the elongated arm 110 in order for the cleaning member 130 to clean grout.

Furthermore, in some embodiments, a liquid dispenser 190 can be coupled to the elongated arm 110 to dispense detergent solutions or other suitable liquid. The liquid dispenser 190 can be attached to a place that would not adversely affect the normal operation of the device 100. The liquid dispenser 190 can be made from a variety of plastics including, for example, polyethylene, polyvinyl chloride, polypropylene, or other suitable materials such as metal or glass. The liquid dispenser 190 may also include a dispensing tube 192 that connects to the cleaning member 130 so that the detergent solutions can be applied to the working surface during normal operation.

In this way, grout cleaning tools disclosed herein enable a user to easily and effectively perform tile and grout cleaning tasks without having to engage in uncomfortable posture and without requiring a large amount energy or muscle strength spent on the reciprocating, repetitive movement associated with such tasks While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A grout cleaning device, comprising:

an elongated arm having a proximal end and a distal end;

a reciprocating motor attached to the distal end and coupled to a power source, wherein the reciprocating motor is detachably coupled to the distal end via a directional connector, the directional connector being rotatably connected to the distal end such that the directional connector is adjustable to cause a reciprocation axis of the reciprocating motor to change;

a grout cleaning member detachably coupled to the reciprocating motor; and a motor controller attached to the proximal end, wherein the motor controller is operable to selectively control the power source.

2. The device of claim 1, wherein the motor controller selectively controls the power source by switching on and off the power source according to an input from a user.

3. The device of claim 1, wherein the motor controller selectively controls the power source by varying an intensity of the power source so as to change an operating speed of the reciprocating motor according to an input from a user.

4. The device of claim 1, wherein the power source is electricity, and wherein the reciprocating motor is coupled to a power cord attachable to an electric outlet to receive the electricity.

5. The device of claim 1, wherein the power source is electricity, and wherein the reciprocating motor is coupled to a battery to receive the electricity.

6. The device of claim 5, wherein the battery is coupled to the elongated arm.

7. The device of claim 1, wherein the directional connector is adjustable to cause the axis of reciprocation of the reciprocating motor to rotate approximately 90 degrees.

8. The device of claim 1, wherein the grout cleaning member comprises:

a motor adaptor assembly; and a brush member coupled to the motor adaptor assembly, wherein the motor adaptor assembly is detachably affixed to the reciprocating motor.

9. The device of claim 8, wherein the motor adaptor assembly comprises an adaptor arm affixable to the reciprocating motor; and an attachment plate attached to the adaptor arm and having a brush socket, wherein the brush member is coupled to the motor adaptor assembly via the brush socket.

10. The device of claim 9, the motor adaptor assembly further comprising:

a plurality of reinforcement ribs to connect the adaptor arm to the attachment plate.

11. The device of claim 1, further comprising:

a handle attached to an upper portion of the elongated arm to provide a pivot for a user.

12. The device of claim 11, wherein the handle is detachable, and wherein the arm provides a plurality of attachment points for securing the handle to the arm.

13. The device of claim 12, wherein the position provided by the plurality of attachment points is ambidextrous.

14. The device of claim 1, wherein the elongated arm includes a telescopic portion to adjust a length of the arm.

15. The device of claim 1, wherein the elongated arm includes one or more contour portions to provide an ergonomic position for the user.

16. The device of claim 1, further comprising an elbow support coupled to the proximal end of the elongated arm.

17. The device of claim 1, further comprising a safety guard extruding from the distal end towards a working surface, the safety guard to prevent the distal end of the arm or the reciprocating motor from contacting the working surface if the grout cleaning member becomes at least partially detached.

18. The device of claim 17, wherein the safety guard comprises a guiding wheel.

19. The device of claim 1, further comprising a liquid dispenser coupled to the elongated arm.

20. The device of claim 1, wherein the reciprocating motor is to move the grout cleaning member back-and-forth in a reciprocating manner.

* * * * *